US006766771B1

(12) United States Patent
Hotton

(10) Patent No.: US 6,766,771 B1
(45) Date of Patent: Jul. 27, 2004

(54) FUEL-FIRED WATER HEATER WITH DUAL FUNCTION COMBUSTION CUTOFF SWITCH IN ITS DRAFT STRUCTURE

(75) Inventor: Bruce A. Hotton, Montgomery, AL (US)

(73) Assignee: The Water Heater Industry Joint Research and Development Consortium, Rio Verde, AZ (US)

( * ) Notice: Subject to any disclaimer, the term of this patent is extended or adjusted under 35 U.S.C. 154(b) by 0 days.

(21) Appl. No.: 10/660,158

(22) Filed: Sep. 11, 2003

(51) Int. Cl.[7] ..... F24H 9/20

(52) U.S. Cl. ..... 122/14.2; 122/14.21; 122/17.1; 122/504; 431/12; 431/76; 431/77

(58) Field of Search ..... 122/13.01, 14.1, 122/14.2, 14.21, 17.1, 504; 431/11, 12, 14, 15, 16, 22, 76, 77

(56) References Cited

U.S. PATENT DOCUMENTS

| | | | | |
|---|---|---|---|---|
| 4,672,919 A | | 6/1987 | Staats | 122/13 R |
| 4,867,106 A | | 9/1989 | Staats | 122/13 R |
| 4,951,651 A | | 8/1990 | Shellenberger | 126/116 R |
| 5,158,446 A | | 10/1992 | Hall | 431/20 |
| 5,199,385 A | | 4/1993 | Doss | 122/504 |
| 5,280,802 A | | 1/1994 | Comuzie, Jr. | 137/65 |
| RE34,534 E | | 2/1994 | Staats | 122/13.1 |
| 5,531,214 A | * | 7/1996 | Cheek | 122/14.1 |
| 5,537,096 A | * | 7/1996 | Wagner | 340/693.6 |
| 5,697,330 A | | 12/1997 | Yetman et al. | 122/13.1 |
| 5,797,358 A | | 8/1998 | Brandt et al. | 122/448.1 |
| 6,053,130 A | * | 4/2000 | Shellenberger | 122/14.21 |
| RE37,745 E | | 6/2002 | Brandt et al. | 122/14.2 |
| 6,412,447 B1 | | 7/2002 | Trant et al. | 122/14.21 |
| 6,497,200 B2 | | 12/2002 | Stretch et al. | 122/504 |
| 6,622,660 B1 | * | 9/2003 | Bajic et al. | 122/13.01 |

FOREIGN PATENT DOCUMENTS

| | | |
|---|---|---|
| EP | 1 122498 | 8/2001 |

* cited by examiner

*Primary Examiner*—Jiping Lu
(74) *Attorney, Agent, or Firm*—Konneker & Smith, P.C.

(57) ABSTRACT

A fuel-fired power vented heating appliance, representatively a water heater, has, in its draft structure, a single thermal or other type of cutoff switch which serves the dual function of preventing (1) the creation of an unacceptably high level of carbon monoxide in the combustion chamber of the appliance, and (2) thermal damage to a PVC vent pipe portion of the draft structure. When triggered, the cutoff switch operates to terminate further firing of the appliance. In one illustrative embodiment of the appliance, this is achieved by preventing further combustion air flow to the appliance. In another illustrative embodiment of the appliance, it is achieved by terminating further fuel flow thereto.

25 Claims, 1 Drawing Sheet

FUEL-FIRED WATER HEATER WITH DUAL FUNCTION COMBUSTION CUTOFF SWITCH IN ITS DRAFT STRUCTURE

BACKGROUND OF THE INVENTION

The present invention generally relates to fuel-fired heating appliances and, in a preferred embodiment thereof, more particularly provides a fuel-fired water heater having A specially designed combustion cutoff system operative to prevent (1) the creation of an unacceptably high level of carbon monoxide in the combustion chamber of the water heater and (2) thermal damage to a PVC vent pipe to which the flue portion of the water heater is connected.

It is now a common practice in the water heater industry to install a flame arrestor structure at or near the combustion chamber portion of a fuel-fired water heater, the flame arrestor being operative to permit combustion air to enter the combustion chamber but inhibit combustion chamber flame outflow through the arrestor in the event that extraneous flammable vapors are ingested into and burned within the combustion chamber. Flame arrestors are potentially susceptible to blockage caused by external contaminants such as lint, dirt and oil. If significant enough, such blockage can create undesirable "sour" combustion within the combustion chamber—a phenomenon caused by an increased level of carbon monoxide within the combustion chamber. To shut down the water heater prior to the point at which such sour combustion occurs, various designs have been previously utilized in which a sensor is positioned within the combustion chamber, the sensor being operative to sense burner flame temperature increase or instability and responsively terminate firing of the water heater prior to the creation in its combustion chamber of an unacceptably high level of carbon monoxide.

In fuel-fired water heaters having associated draft inducer fans coupled to PVC vent pipes, another design criteria that needs to be satisfied is the prevention of thermal damage to these meltable plastic vent pipes caused by excessive temperature in water heater combustion products internally traversing them. This has previously been accomplished by installing in the draft inducer fan a thermal device which is operative to shut down the water heater prior to the temperature of the combustion products traversing the vent pipe reaching an unacceptably high level.

Thus, at least two separate sensors—one in the draft structure of the water heater and one in its combustion chamber—have previously been necessary to protect the PVC vent pipe from thermal damage and prevent excess carbon monoxide levels from being created in the combustion chamber. This undesirably increases both the complexity and manufacturing cost of the water heater. It would thus be desirable to provide these protective features in a simpler, more cost effective manner. It is to this design objective that the present invention is primarily directed.

SUMMARY OF THE INVENTION

In carrying out principles of the present invention, in accordance with illustrated embodiments thereof, a fuel-fired heating appliance, representatively a water heater, is provided with a specially designed combustion shutoff system which substantially prevents thermal damage to a draft structure portion of the appliance, and also substantially prevents the creation of an undesirably high concentration of carbon monoxide within the combustion chamber of the appliance during firing thereof.

In illustrated embodiments thereof, the fuel-fired water heater, which may be either a natural draft or power vented water heater, basically comprises a tank adapted to store a quantity of water to be heated, a combustion chamber positioned beneath the tank, and a fuel burner disposed within the tank and being operative to burn received fuel and combustion air and responsively create hot combustion products in the combustion chamber. A valve is coupled to the burner and is operative to permit and preclude the supply of fuel thereto, and a passage is provided through which combustion air may be supplied to the burner.

A flue extends from the combustion chamber, and through the interior of the tank, and has an outlet. Coupled to the flue outlet is a draft structure which includes a vent pipe, the draft structure being operative to create a draft through the flue to facilitate discharge of combustion products from the flue outlet and through the vent pipe. The water heater further comprises a draft structure which is coupled to the flue outlet and includes a vent pipe, the draft structure being operative to create a draft through the flue to facilitate discharge of combustion products from the flue outlet and through the vent pipe.

In accordance with a key aspect of the invention, cutoff apparatus is provided which is operative to sense a parameter, preferably temperature, of combustion products traversing the draft structure and, in response to a predetermined magnitude of the parameter, prevent the creation of an unacceptably high level of carbon monoxide in the combustion chamber, and thermal damage to the vent pipe caused by an unacceptably high temperature of combustion products traversing the draft structure, by terminating further firing of the water heater, the magnitude of the parameter being correlated in a predetermined manner to both the level of carbon monoxide in the combustion chamber and the unacceptably high temperature of combustion products traversing the draft structure.

From a draft structure standpoint the water heater may be either a power vented water heater or a natural draft water heater. In illustrated embodiments of a power vented water heater the draft structure includes a draft inducer fan coupled between the water heater flue and a PVC plastic vent pipe, and the cutoff structure is a thermal switch disposed within the draft inducer fan. In response to the combustion product temperature within the draft inducer fan reaching the set point temperature of the thermal switch, the switch outputs a control signal which, in one embodiment of the water heater, is used to terminate water heater firing by preventing further fuel supply to the burner, and in another embodiment of the water heater by preventing further combustion air supply to the burner. In a natural draft embodiment of the water heater, the thermal switch is positioned within the natural draft structure of the water heater adjacent the PVC vent pipe and may be similarly utilized to terminate firing of the water heater by shutting off either fuel or combustion air supply thereto.

DETAILED DESCRIPTION

Figure 1:
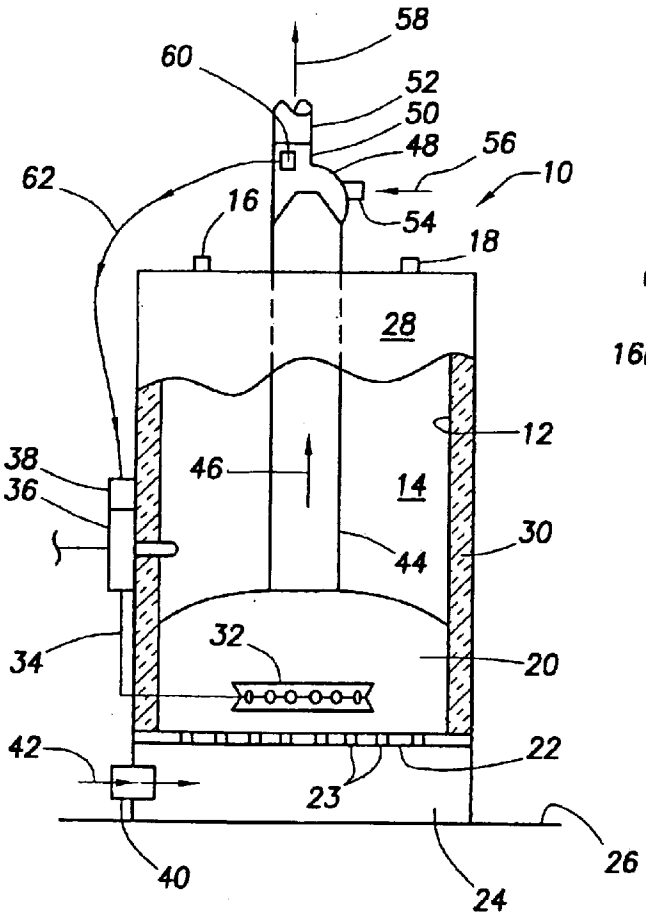
FIG. 1 is a schematic cross-sectional view through a fuel-fired, power vented water heater embodying principles of the present invention.

Schematically depicted in partially cross-sectional form in FIG. 1 is a fuel-fired heating appliance, representatively in the form of a gas-fired, power vented water heater 10, which embodies principles of the present invention. Water heater 10 has a vertically oriented metal tank 12 in which a quantity of water 14 to be heated is stored, the tank having the usual cold water inlet and hot water outlet pipe connections 16,18 at its top end. A combustion chamber 20 is positioned beneath a bottom end of the tank 12, with a bottom wall of the combustion chamber 20 being defined by a perforated flame arrestor plate 22 (having flame quenching perforations 23 therein) that, in turn, overlies a combustion air intake plenum 24 extending upwardly from the floor 26 upon which the water heater 10 rests.

A metal jacket 28 extends outwardly around the tank 12 and combustion chamber 20 and defines therewith an insulation cavity which is filled with a suitable insulation material 30. A gas burner 32 is operatively disposed within the combustion chamber 20 and is supplied with gaseous fuel via a gas supply pipe 34 in which a thermostatic gas valve 36 is interposed. A conventional control module 38 is operatively associated with the gas valve 36. Extending into the intake plenum 24 is a combustion air supply duct 40 through which ambient combustion air 42 may flow into the plenum 24.

A flue 44 having a bottom end communicating with the interior of the combustion chamber 20 extends upwardly through the water 14 in the tank 12 and outwardly through an upper end portion of the tank, and has a top end portion operatively connected to a draft structure that functions to facilitate the upward movement through the flue 44 of hot combustion products 46 created in the combustion chamber 20 by burner combustion of air and fuel delivered thereto. The hot combustion products 46 flowing upwardly through the flue 44 transfer combustion heat to the water 14 in the tank 12. Combustion air 42 entering the combustion chamber 20 passes sequentially through the duct 40, the plenum 24 and then upwardly through the perforations 23 in the arrestor plate 22. In a known manner, the perforations operate to permit entry of combustion air 42 into the combustion chamber, but substantially inhibit outward flame passage from the combustion chamber 20 created, for example, by ignition of extraneous flammable vapors within the combustion chamber 20.

The previously mentioned draft structure at the upper end of the water heater 10 includes a draft inducer fan 48 having an inlet to which an upper end of the flue 44 is coupled, and an outlet 50 connected to a PVC plastic vent pipe 52. Fan 48 has a dilution air inlet 54 for receiving ambient air 56. During firing of the water heater 10 the hot combustion products 46 and the ambient air 56 are drawn into the fan 48, the air 56 serving to cool the combustion products 46 interiorly traversing the fan 48 so that cooled combustion products 58 are discharged from the fan 48 into the plastic vent pipe 52.

In this general type of water heater, two combustion-related problems can potentially occur. First, if the temperature of combustion products 58 entering the PVC vent pipe 52 exceeds a predetermined limit temperature, the pipe 52 can be thermally damaged. Second, clogging of the flame arrestor plate perforations 23 can create undesirable "sour" combustion within the combustion chamber 20—i.e., a combustion-created undesirably high level of carbon monoxide within the combustion chamber 20. According to a key aspect of the present invention, a single cutoff switch 60 is used to sense a parameter of combustion products traversing the draft structure 48,52 and, in response to sensing a predetermined magnitude of such parameter, provide the dual function of preventing both (1) the creation of a predetermined, unacceptably high level of carbon monoxide in the combustion chamber 20 and (2) thermal damage to the PVC vent pipe 52 caused by an unacceptably high temperature combustion products traversing it.

Although other parameters (such as, for example, carbon monoxide concentration) could potentially be sensed by the cutoff switch 60 within the draft structure, the illustrated cutoff switch 60 is preferably disposed within the draft inducer fan 48 and is preferably a thermal switch that senses the temperature within the fan 48. The set point temperature of the switch 60 is a temperature which is both (1) below the maximum operating temperature of the PVC vent pipe 52 and (2) correlated to a concentration of carbon monoxide in the combustion chamber 20 less than a concentration which creates undesirable "sour" combustion therein.

When this predetermined dual function set point temperature is sensed, the switch 60 outputs a control signal 62 which may be utilized to terminate further combustion within the combustion chamber 20. Illustratively, as schematically shown in FIG. 1, the signal 62 is transmitted to the control module 38 which responsively closes the gas valve 36 to thereby terminate firing of the water heater 10.

Figure 2:
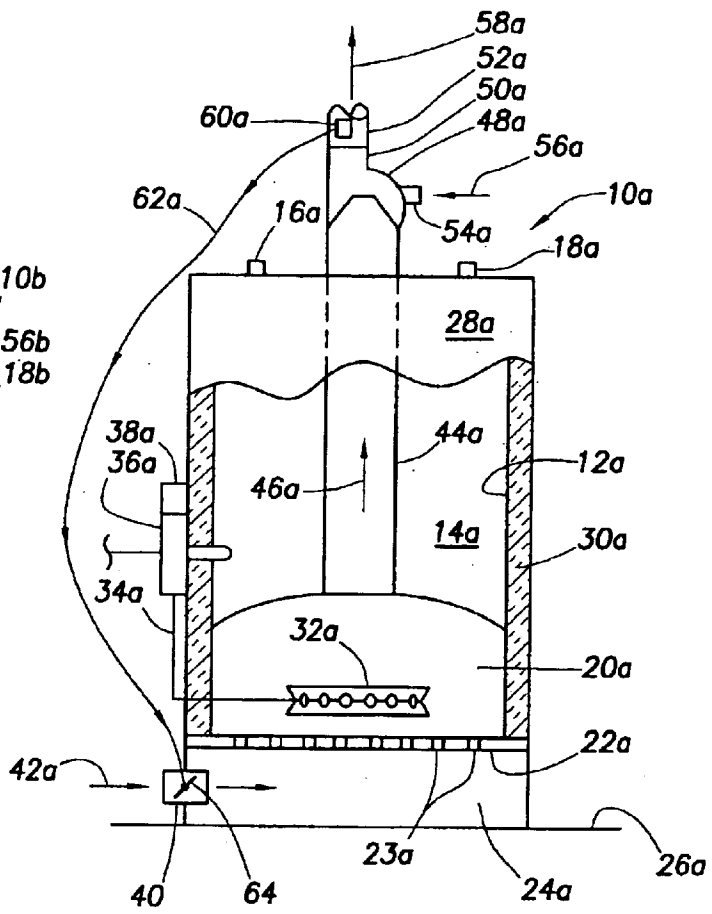
FIG. 2 is a schematic cross-sectional view through an alternate power vented embodiment of the FIG. 1 water heater.

A first alternate embodiment 10*a* of the FIG. 1 water heater 10 is schematically depicted in FIG. 2. For ease in comparison of the water heater embodiments 10 and 10*a*, components in the water heater 10*a* similar to those in the previously described water heater 10 have been given identical reference numerals having the subscripts "a".

Water heater 10*a* is a power vented water heater identical to the water heater 10 with the exception that the dual function thermal cutoff switch 60*a* is utilized to terminate firing of the water heater 10*a* by preventing further delivery of combustion air 42*a* to the combustion chamber 20*a* instead of terminating further delivery of fuel to the burner 32*a*. Specifically, in the water heater 10*a* a control damper 64 is installed in the combustion air supply duct 40*a*, with the cutoff switch control signal 62*a* being transmitted to the damper 64, to close it and prevent further combustion air inflow into the combustion chamber 20*a*, in response to the set point temperature of the cutoff switch 60*a* being reached.

Figure 3:
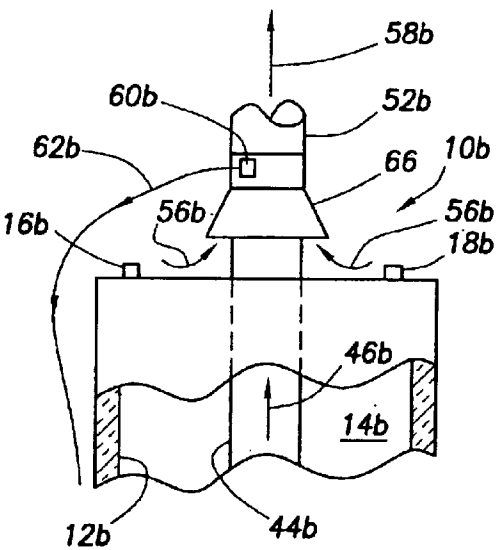
FIG. 3 is a schematic cross-sectional view through a top end portion of a natural draft embodiment of the FIG. 1 water heater.

Schematically illustrated in a partially cross-sectional fashion in FIG. 3 is an upper end portion of a second alternate embodiment 10*b* of the previously described water heater 10. For ease in comparison of the water heater embodiments 10 and 10*b*, components in the water heater 10*b* similar to those in the previously described water heater 10 have been given identical reference numerals having the subscripts "b".

The water heater 10*b* is substantially identical to the previously described water heater 10 with the exception that the water heater 10*b* is a natural draft water heater instead of a power vented water heater, the draft structure of the water heater 10*b* including a draft hood 66 operatively positioned over the open upper end of the flue 44*b* and coupled to a PVC vent pipe 52*b*. During firing of the water heater 10*b*, ambient air 56*b* is drawn into the draft hood 66 for mixture with and cooling of the hot combustion products 46*b*. The thermal cutoff switch 60*b* is installed within the draft structure 66,52*b*, and the control signal 62*b* generated by the switch 60*b* in response to its set point being reached may be utilized, as previously discussed in conjunction with the water heater embodiments 10 and 10*a*, to either terminate further combustion air flow to the combustion chamber of the water heater 10*b* or to terminate further fuel flow to its burner.

While the present invention has been representatively illustrated and described herein as being incorporated in various water heaters, principles of the invention may also be utilized to advantage in various other types of fuel-fired heating appliances, such as for example boilers and furnaces, and the invention is not limited to water heaters.

The foregoing detailed description is to be clearly understood as being given by way of illustration and example only, the spirit and scope of the present invention being limited solely by the appended claims.

What is claimed is:

1. A fuel-fired heating appliance comprising:

a combustion chamber;

a burner disposed in said combustion chamber and operative to burn received fuel and combustion air and responsively create hot combustion products in said combustion chamber;

a flue extending from said combustion chamber and operative to receive said hot combustion products, said flue having an outlet;

a draft structure coupled to said flue outlet and including a vent pipe, said draft structure being operative to create a draft through said flue to facilitate discharge of combustion products from said flue outlet and through said vent pipe; and cutoff apparatus operative to sense a parameter of hot combustion products traversing said draft structure and, in response to a predetermined magnitude of said parameter, prevent both (1) the creation of a predetermined, unacceptably high level of carbon monoxide in said combustion chamber, and (2) thermal damage to said vent pipe caused by an unacceptably high temperature of combustion products traversing said draft structure, by terminating further firing of said heating appliance, said magnitude of said parameter being correlated in a predetermined manner to both the level of carbon monoxide in said combustion chamber and said unacceptably high temperature of combustion products traversing said draft structure.

2. The fuel-fired heating appliance of claim 1 wherein:

said heating appliance is a fuel-fired water heater.

3. The fuel-fired heating appliance of claim 2 wherein:

said heating appliance is a natural draft heating appliance.

4. The fuel-fired heating appliance of claim 2 wherein:

said heating appliance is a power vented heating appliance.

5. The fuel-fired heating appliance of claim 4 wherein:

said draft structure includes a draft inducer fan operatively interconnected between said flue outlet and said vent pipe, and said cutoff apparatus includes a thermal switch sensing an internal temperature within said draft inducer fan.

6. The fuel-fired heating appliance of claim 1 wherein:

said cutoff apparatus is operative to terminate further firing of said heating appliance by preventing further delivery of combustion air to said burner.

7. The fuel-fired heating appliance of claim 1 wherein:

said cutoff apparatus is operative to terminate further firing of said heating appliance by preventing further delivery of fuel to said burner.

8. The fuel-fired heating appliance of claim 1 wherein:

said parameter sensed by said cutoff apparatus is temperature.

9. The fuel-fired heating appliance of claim 8 wherein:

said vent pipe is of a meltable plastic material.

10. A fuel-fired water heater comprising:

a tank adapted to store a quantity of water to be heated;

a combustion chamber positioned beneath said tank;

a fuel burner disposed within said tank and being operative to burn received fuel and combustion air and responsively create hot combustion products in said combustion chamber;

a valve coupled to said burner and through which fuel may be supplied to said burner;

a passage through which combustion air may be supplied to said burner;

a flue extending from said combustion chamber and upwardly through the interior of said tank, said flue having an outlet;

a draft structure coupled to said flue outlet and including a vent pipe, said draft structure being operative to create a draft through said flue to facilitate discharge of combustion products from said flue outlet and through said vent pipe; and cutoff apparatus operative to sense a parameter of combustion products traversing said draft structure and, in response to a predetermined magnitude of said parameter, prevent the creation of an unacceptably high level of carbon monoxide in said combustion chamber, and thermal damage to said vent pipe caused by an unacceptably high temperature of combustion products traversing said draft structure, by terminating further firing of said water heater, said magnitude of said parameter being correlated in a predetermined manner to both the level of carbon monoxide in said combustion chamber and said unacceptably high temperature of combustion products traversing said draft structure.

11. The fuel-fired water heater of claim 10 wherein:

said fuel-fired water heater is a natural draft water heater.

12. The fuel-fired water heater of claim 10 wherein:

said fuel-fired water heater is a power vented water heater.

13. The fuel-fired water heater of claim 12 wherein:

said draft structure includes a draft inducer fan operatively interconnected between said flue outlet and said vent pipe, and said cutoff apparatus includes a thermal switch sensing an internal temperature within said draft inducer fan.

14. The fuel-fired water heater of claim 10 wherein:

said cutoff apparatus is operative to terminate further firing of said water heater by closing said valve.

15. The fuel-fired water heater of claim 10 wherein:

said combustion air passage has a shutoff damper associated therewith, and said cutoff apparatus is operative to terminate further firing of said water heater by closing said shutoff damper.

16. The fuel-fired water heater of claim 10 further comprising:

a flame arrestor through which combustion air must pass before entering said combustion chamber for delivery to said burner.

17. The fuel-fired water heater of claim 10 wherein:

said parameter sensed by said cutoff apparatus is temperature.

18. The fuel-fired water heater of claim 17 wherein:

said vent pipe is of a meltable plastic material.

19. A fuel-fired water heater comprising:

a tank adapted to store a quantity of water to be heated;

a combustion chamber positioned beneath said tank;

a fuel burner disposed within said tank and being operative to burn received fuel and combustion air and responsively create hot combustion products in said combustion chamber;

a valve coupled to said burner and through which fuel may be supplied to said burner;

a passage through which combustion air may be supplied to said burner;

a flue extending from said combustion chamber and upwardly through the interior of said tank, said flue having an outlet;

a draft structure coupled to said flue outlet and including a vent pipe having a maximum permissible operating temperature, said draft is structure being operative to create a draft through said flue to facilitate discharge of combustion products from said flue outlet and through said vent pipe; and a thermal switch operative to sense the temperature of combustion products internally traversing said draft structure responsively terminate further firing of said water heater when the sensed temperature reaches a predetermined magnitude below said maximum permissible operating temperature and correlated in a predetermined manner to a maximum permissible carbon monoxide level in said combustion chamber.

20. The fuel-fired water heater of claim 19 wherein:

said water heater is a natural draft water heater.

21. The fuel-fired water heater of claim 19 wherein:

said water heater is a power vented water heater.

22. The fuel-fired water heater of claim 21 wherein:

said draft structure includes a draft inducer fan, and said thermal switch is disposed within said draft inducer fan.

23. The fuel-fired water heater of claim 19 wherein:

said thermal switch is operative to terminate further firing of said water heater by preventing further delivery of combustion air to said burner.

24. The fuel-fired water heater of claim 19 wherein:

said thermal switch is operative to terminate further firing of said water heater by preventing further delivery of fuel to said burner.

25. The fuel-fired water heater of claim 19 further comprising:

a flame arrestor through which combustion air must pass before entering said combustion chamber for delivery to said burner.

* * * * *

UNITED STATES PATENT AND TRADEMARK OFFICE

CERTIFICATE OF CORRECTION

PATENT NO. : 6,766,771 B1
APPLICATION NO. : 10/660158
DATED : July 27, 2004
INVENTOR(S) : Bruce A. Hotton It is certified that error appears in the above-identified patent and that said Letters Patent is hereby corrected as shown below:

Column 2, line 6, change “tank” to --combustion chamber--.
Column 6, line 6 (claim 10, line 4), change “tank” to --combustion chamber--.
Column 7, line 2 (claim 19, line 4), change “tank” to --combustion chamber--.

Signed and Sealed this

First Day of May, 2007

JON W. DUDAS
*Director of the United States Patent and Trademark Office*